US006105824A

United States Patent [19]

Singleton

[11] Patent Number: 6,105,824

[45] Date of Patent: Aug. 22, 2000

[54] AUTO SHUT-OFF GLUE GUN

[75] Inventor: Michael A. Singleton, Warwick, R.I.

[73] Assignee: Stanley Fastening Systems, L.P., East Greenwich, R.I.

[21] Appl. No.: 09/211,287

[22] Filed: Dec. 16, 1998

Related U.S. Application Data

[63] Continuation-in-part of application No. 29/079,212, Nov. 14, 1997, Pat. No. Des. 404,622.

[60] Provisional application No. 60/069,744, Dec. 16, 1997.

[51] Int. Cl.[7] ..... B67D 5/62

[52] U.S. Cl. ..... 222/146.5; 219/221; 219/227; 219/229; 401/2

[58] Field of Search ..... 222/146.5, 325; 219/221, 227, 229; 401/2

[56] References Cited

U.S. PATENT DOCUMENTS

| | | |
|---|---|---|
| 3,598,282 | 8/1971 | Phillips et al. . |
| 3,668,479 | 6/1972 | Weston et al. . |
| 3,758,001 | 9/1973 | Callan . |
| 4,355,222 | 10/1982 | Geithman et al. . |
| 4,360,128 | 11/1982 | Neumann . |
| 4,535,916 | 8/1985 | Macherle et al. . |
| 4,545,504 | 10/1985 | Fabel et al. . |
| 4,546,235 | 10/1985 | Költer . |
| 4,664,296 | 5/1987 | Dziki . |
| 4,830,219 | 5/1989 | Siemann . |
| 4,951,846 | 8/1990 | Oster et al. . |
| 5,362,164 | 11/1994 | Wingert . |
| 5,367,146 | 11/1994 | Grunig . |
| 5,414,247 | 5/1995 | Geithman et al. . |
| 5,479,914 | 1/1996 | Tsai . |

FOREIGN PATENT DOCUMENTS

| | | |
|---|---|---|
| 2 595 061 | 9/1987 | France . |

*Primary Examiner*—Kevin Shaver
*Assistant Examiner*—David Deal
*Attorney, Agent, or Firm*—Pillsbury Madison & Sutro LLP

[57] ABSTRACT

The present invention relates to a glue gun for selectively supply molten adhesive. The glue gun comprises a housing, an actuator movable between actuated and non-actuated positions, and a nozzle configured to allow molten adhesive to flow therethrough. The housing an adhesive receiving chamber fluidly communicated with the nozzle. The chamber has an opening at one end thereof for allowing a supply of solidified adhesive to be inserted into said chamber. A heating element is associated with the chamber. The heating element is operable to apply heat to the lead end portion of the solidified adhesive supply sufficient to melt the lead end portion when an electric signal is applied to the heating element. A heating element controller operates to allow the electric signal to flow to the heating element for a period of time after the actuator has been moved to its non-actuated position and to thereafter prevent the electric signal from flowing through the heating element at the end of the time period. The present invention also relates to a timing circuit for controlling the amount of time an electric signal is supplied to an operative element.

14 Claims, 7 Drawing Sheets

AUTO SHUT-OFF GLUE GUN

The present application claims priority of U.S. Provisional Appln. Ser. No. 60/069,744 filed Dec. 16, 1997, and a c-i-p of Ser. No. 29/079,212, filed Nov. 14, 1997, now U.S. Pat. No. Design 404,622, the entirety of each being incorporated into the present application by reference.

The present invention relates generally to an auto shut-off glue gun and, more particularly, to a glue gun having a timing control circuit that upon release of the glue gun trigger, turns off the heating element after a predetermined amount of time. The present invention also relates to a timing circuit that controls an operative element.

Glue guns are well-known for dispensing molten thermoplastic materials. Generally, such devices comprise a barrel member having an internal melting chamber which communicates with an outlet opening through a nozzle. The internal melting chamber is made of a thermally conductive material, such as aluminum, and is configured to receive a solidified supply of adhesive therein. An electrical heating element is used for heating the melting chamber. The heating element generates heat via the conversion of electrical energy flowing through the heating element. The heating element heats the barrel member to melt the end portion of the block therein. Glue guns also generally include a handle adapted to be gripped with one hand while the user presses the block through the sleeve and into the melting chamber to force molten thermoplastic material out of the melting chamber through the nozzle. However, many glue guns also include a pusher member for pushing the supply forward as a result of depressing the actuator Typically, glue guns are plugged into an electric signal service such as an AC wall outlet. In some glue guns, shutting off the heating element, consists of removing the AC plug from the wall outlet. Such a device is illustrated in U.S. Pat. No. 5,362,164, to Wingert, and its disclosure is incorporated herein. This type of glue gun may present a fire hazard because the heating element continuously generates heat when the gun is accidentally left plugged-in. These glue guns typically use a positive temperature coefficient (PTC) heating element which is regulated so as not to exceed a predetermined temperature. PTC heating elements typically only have an operating life of approximately 1000 hours. Thus, leaving the gun plugged in not only presents a safety hazard, but it also has detrimental effect of the life of the heating element.

Thus, there exists a need for a glue gun which is operable to allow the heating element to generate heat for a short period of time when the gun is not being actively used and to then de-activate the heating element after a predetermined period of time has passed since the last usage. In order to meet this need, the present invention provides a glue gun comprising a housing having a manually engageable handle portion, a manually operable actuator or trigger movable between an actuated position and a non-actuated position, and a nozzle configured to allow molten hot-melt adhesive to flow therethrough. The housing has interior surfaces defining an adhesive receiving chamber fluidly communicated with the nozzle and the chamber has an opening at one end thereof for allowing a supply of solidified hot-melt adhesive to be inserted into the chamber. A heating element is associated with the chamber and is positioned so as to be disposed adjacent to a lead end portion of the solidified adhesive supply when the adhesive supply is inserted into the chamber.

The heating element is operable to apply heat to the lead end portion of the solidified adhesive supply sufficient to melt the lead end portion when an electric signal is supplied to the heating element. The chamber is constructed and arranged such that pressure can be applied to the solidified adhesive supply so as to force the molten adhesive from the lead end portion thereof outwardly through the nozzle.

A heating element controller has a signal source input adapted to be connected to an electric signal source in power supplying relation. The controller is operable to connect the heating element to the signal source input so as to allow an electric signal from the signal source to flow through the heating element in response to the actuator being moved to the actuated position thereof, thereby causing the heating element to generate and apply heat to the lead end portion of the solidified adhesive supply. The controller is also operable to allow the electric signal to flow from the signal source through the heating element for a predetermined period of time after the actuator has been moved to the non-actuated position thereof, thereby causing the heating element to continue generating and applying heat to the lead end portion of the solidified adhesive supply for the predetermined time period and then subsequently allowing the heating element to cool.

It can thus be appreciated that a glue gun constructed in accordance with the principles of the present inventions provides a safe and effective solution to the problems associated with leaving known glue guns in an actuated condition. More specifically, the controller will automatically shut-off the heating element after a pre-determined period of time to prevent an unattended glue from becoming a safety hazard. Further, the glue gun of the present invention is advantageous over guns in which the heating element shuts-off immediately after releasing the actuator because the heating element continues to generate heat for a period of time after the actuator has been moved to its non-acutated position, thereby allowing the user to leave the gun unattended while attending to another task and then return to using the gun without waiting for the element to re-heat. Although the following detailed description discloses the controller as being an electrical circuit, it is to be understood that the functions performed by the controller may be performed by any means now known or later developed, such as a microchip controlled or a internal timing clock controlled system.

Another aspect of the present invention relates to a timing circuit for controlling the amount of time an electric signal is supplied to an operative element from an electric signal source. It should be noted that this aspect of the present invention is not limited to glue guns and/or heating elements may be applied to a wide variety of electrically operated elements.

Available timing circuits typically comprise an integrated circuit that uses the 60 Hz frequency of an AC line voltage for establishing the required time period. Specifically, the line voltage is input into a multiplier and the basic unit of time drawn from the 60 Hz signal is multiplied to achieve the desired time period in the circuit. However, the cost of such an integrated timing circuit is relatively high and precludes its incorporation into devices such as the glue gun of the present invention.

It is therefore an object of the present invention to provide a timing circuit which is relatively simple and low-cost, yet fully effective. In order to meet this objective, the present invention provides a timing circuit for controlling the amount of time an electric signal is supplied to an electrically powered operative element from an electric signal source. The circuit comprises an input adapted to be connected to the electric signal source in power supplying relation. The input is connected to the operative element. A time constant circuit is operable to produce a timing circuit signal having a voltage $V_{timing}$. A reference voltage circuit is connect to the input. The reference voltage circuit is operable to produce a reference signal having a voltage $V_{ref}$. A reset switch is selectively movable between (1) an actuated position wherein the reset switch allows the electric signal to flow from the signal source to the time constant circuit and (2) an non-actuated position wherein the switch prevents the electric signal from flowing to the time constant circuit. An operational amplifier has a non-inverting terminal and an inverting terminal. One of the terminals receives the timing circuit signal from the time constant circuit and the other terminal receives the reference signal from the reference voltage circuit. Preferably, the non-inverting terminal receives the timing circuit signal and the inverting terminal receives the reference signal. The operational amplifier is operable to produce a control signal proportional to the difference between $V_{timing}$ and $V_{ref}$.

A switching element is connected to the operational amplifier and receives the control signal therefrom. The switching element is movable between (1) a flow permitting position wherein the switching element allows the electric signal to flow from the signal source to the operative element and (2) a flow preventing position wherein the switching element prevents the electric signal from flowing from the electric signal source to the operative element. The switching element is operable to move to the flow permitting position thereof when the control signal is high as a result of $V_{timing}$ being greater than $V_{ref}$ and to move to the open position thereof when the control signal is low as a result of $V_{timing}$ being equal to $V_{ref}$. The time constant circuit is operable to become energized when the reset switch is moved to the actuated position thereof such that, after the reset switch is moved to the non-actuated position thereof, the time constant circuit will continue to supply the timing circuit signal to the one terminal of the operational amplifier. The time constant circuit is operable such that the voltage $V_{timing}$ of the timing circuit signal will decay over a period of time until the timing equals $V_{ref}$, thereby causing the switching element to move to the flow preventing position thereof and preventing the electric signal from flowing to the operative element.

It can thus be appreciated that a timing circuit constructed in accordance with the present invention offers a low-cost and simplified alternative to presently available integrated timing circuits. It is to be understood that the applications of the timing circuit of the present invention is not to be limited to the glue gun disclosed and may be applied broadly to any electrically powered operative elements.

Other objects, features, and advantages will become apparent from the following detailed description, the accompanying drawings, and the appended claims.

DETAILED DESCRIPTION OF THE PREFERRED EMBODIMENT OF THE PRESENT INVENTION

A. Structural Description

Figure 1:
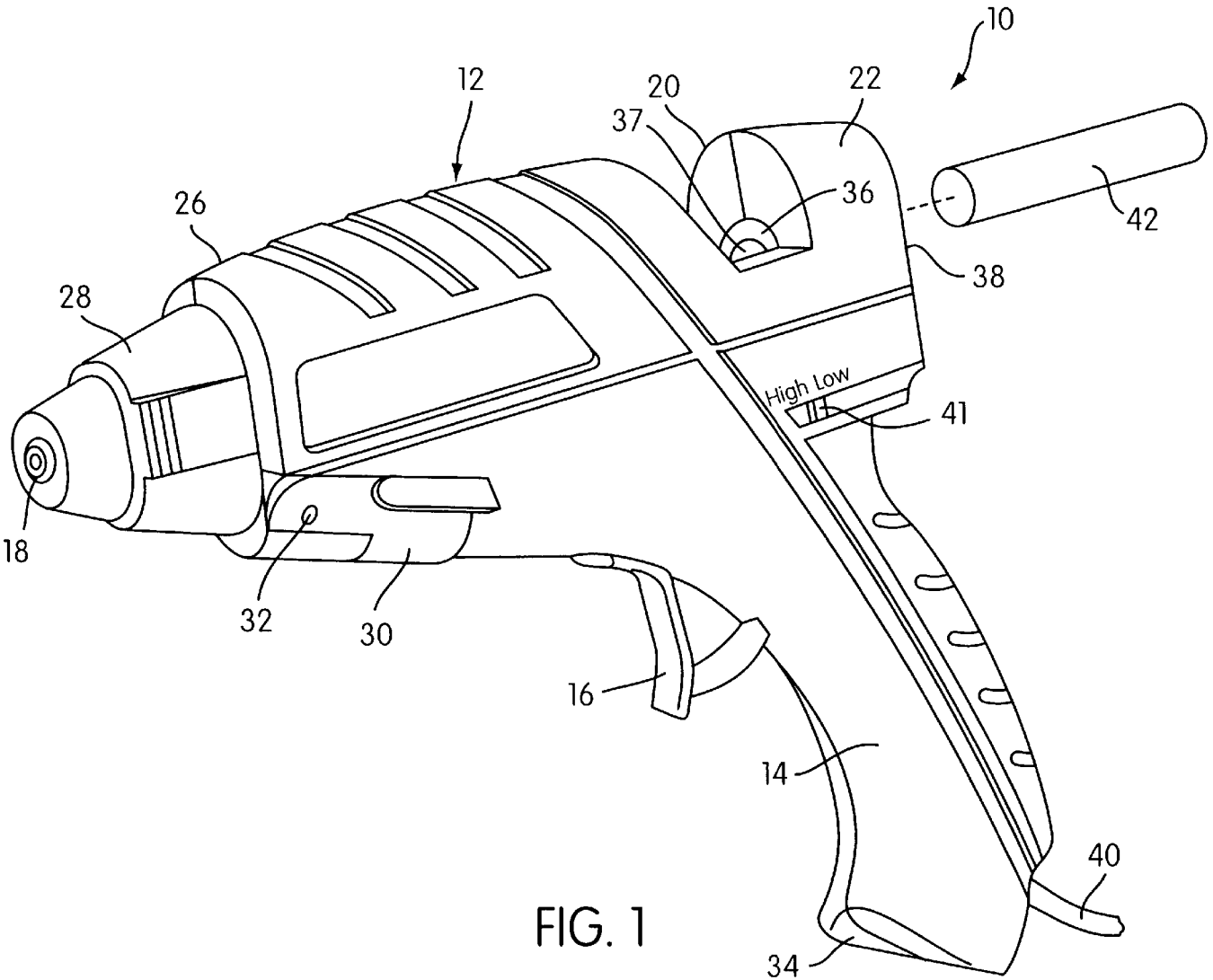
FIG. 1 is a perspective view of the glue gun of the present invention.

FIG. 1 shows a glue gun, generally indicated at 10, constructed in accordance with the present invention. The gun 10 includes a housing 12 constructed of two housing halves 20, 22 preferably molded of plastic. The housing 12 has a front portion 26 in which a heating element 80 and interior surfaces defining a chamber 27 (shown in FIG. 3) are located. Specifically, the chamber 27 is defined by the interior surface of a flexible adhesive receiving sleeve 25, preferably made of rubber, and the interior surface of a tubular portion extending through the heating element 80. The chamber 27 is cylindrically shaped and adapted for receiving a generally cylindrical stick of solidified adhesive. The heating element 80 surrounds a forward end portion of the chamber 27 proximal a nozzle 18. The nozzle 18 is connected to the housing 12 and has an opening fluidly communicated to the chamber 27 and so as to allow adhesive melted in the chamber 27 by the heating chamber 80 to flow outwardly onto a workpiece. A nozzle sleeve 28 is fixed to the exterior of the nozzle 18 adjacent the housing 12. The nozzle sleeve 28 is made of flexible rubber and insulates the metallic nozzle to protect an operator from the heat which may flow through the nozzle from the heating element. A manually engageable handle portion in the form of a pistol grip portion 14 is configured to be gripped comfortably by the user of the glue gun 10.

The glue gun 10 is manually operated and includes an actuator or trigger 16 that is pivotally connected to the housing 12. The trigger 16 is configured to be conveniently actuatable by the index finger of the user's hand that is gripping the pistol grip 14. A glue gun stabilizer 30 is pivotally attached by pivot pins 32 to the front portion of the housing 12. When the stabilizer 30 pivots from an inoperative position to an operative position, the user can rest the glue gun 10 on a flat surface such as a table or workbench such that the stabilizer 30 and a resting surface 34 of the pistol grip 14 cooperate to stably support the glue gun 10 in an upright position. The stabilizer 30 and the resting surface 34 are configured in such a way that the glue gun 10 may be supported by the two structures in a "resting position." In the resting position, the nozzle tip 18 rests a short distance, approximately 1.25 centimeters, from the workpiece. It can be appreciated that the stabilizer 30 and resting surface 34 may be altered or modified to adjust the distance between the nozzle 18 and the workpiece in the resting position.

An adhesive pusher 36 has an open configuration with a generally cylindrical receiving bore 37 formed therethrough for receiving a solidified adhesive supply in the form of a generally cylindrical glue stick 42. The pusher 36 is arranged within the housing 12 such that the bore 37 is generally coaxial with the chamber 27 so that the adhesive supply can be inserted into the bore 37 with the lead end portion thereof being positioned inside chamber 27. The pusher 36 is constructed and arranged to push the solidified adhesive supply 42 disposed in the chamber 27 forwardly towards the nozzle 18, thus forcing the molten adhesive from the lead end portion of the supply outwardly from the opening in the nozzle 18. The housing halves 20, 22 cooperate to define a generally circular opening 38 for receiving the generally cylindrical glue stick 42.

The pusher 36 also has a forwardly extending shield portion 39 with a generally semi-circular configuration. The shield portion 39 is formed integrally with the pusher 36 and is positioned below the rubber sleeve 25. The positioning of the shield portion 37 allows it to slide under the sleeve during forward movement of the pusher 36 and shields the internal components of the glue gun 10 when the pusher is disposed rearwardly in its rear retracted position.

The pusher 36 also has a pair of laterally extending guide portions (not shown) which are received within a pair of grooves (not shown) formed within the housing 12. These guide portions and grooves cooperate to guide the pusher 36 rectilinearly forwardly and rearwardly during operation of the gun 10.

A power cord 40 plugs into an electric signal source such as an AC wall outlet to provide electrical power to the glue gun 10. The user can adjust the heating level of the heating element 80 to a high or low level using a heat level switch 41.

Figure 2:
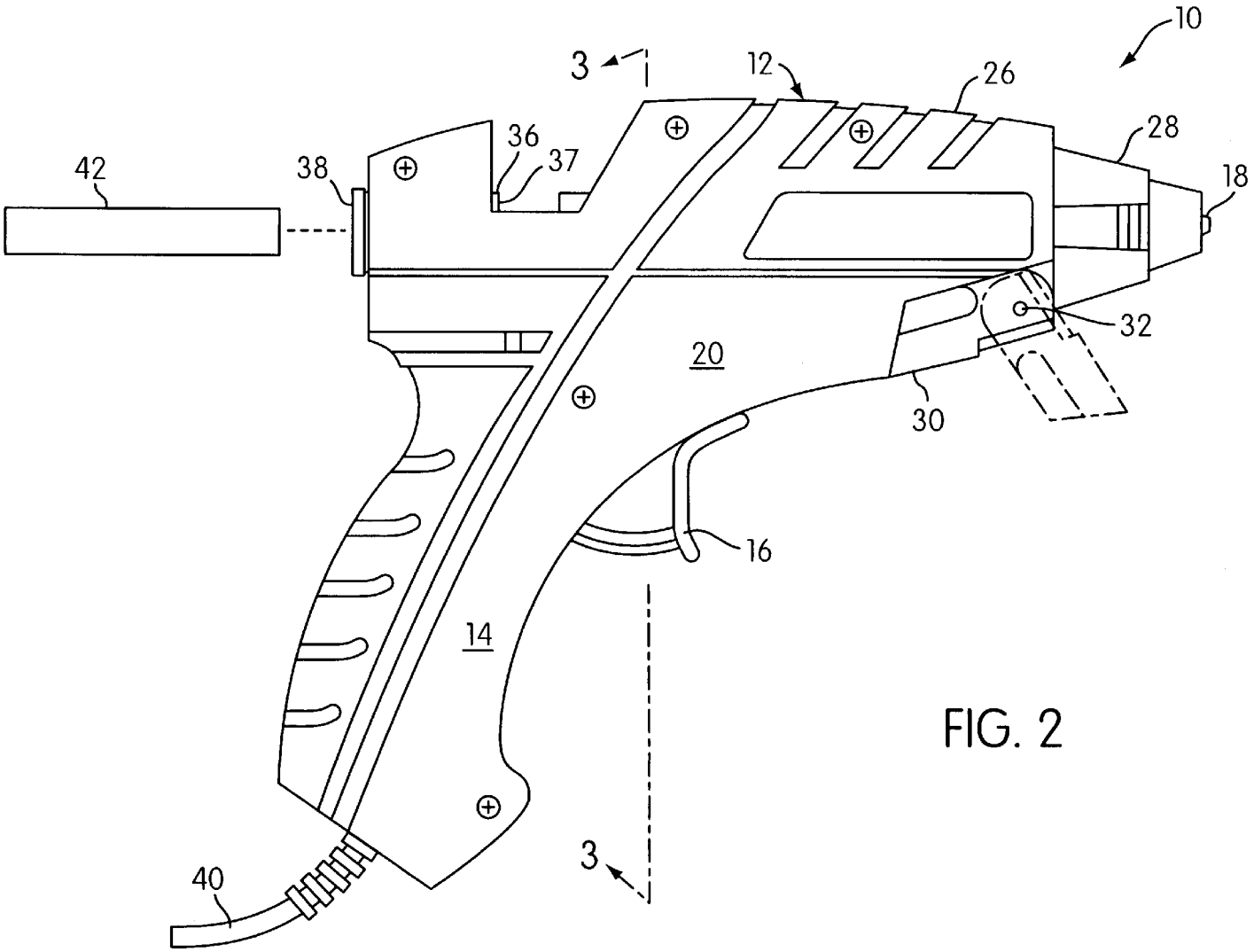
FIG. 2 is a side elevational view of the glue gun shown in FIG. 1.

FIG. 2 is a side elevational view of the glue gun 10 with the trigger 16 thereof in the non-actuated position and the stabilizer 30 shown in the inoperative position in solid lines and in its operative position in phantom. Although not shown in the Figures, the front end portion 26 of the housing 12 has an arcuate groove on each side thereof adjacent to the stabilizer 30 and the stabilizer 30 has a pair of inwardly extending projections which are slidably received in the grooves. One end of each groove has a narrowed portion which releaseably locks the stabilizer projections in place to secure the stabilizer in its operative position.

Figure 3:
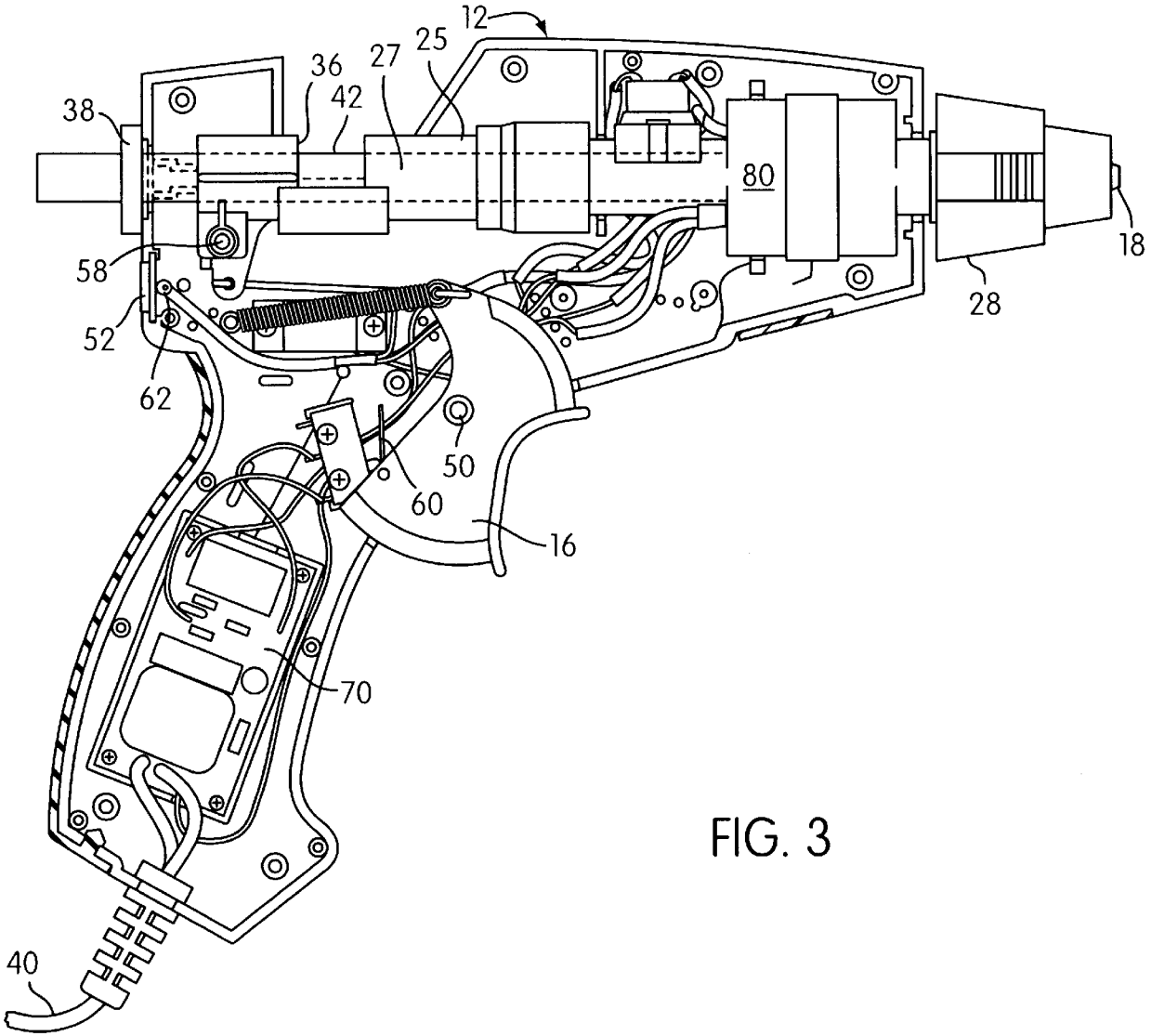
FIG. 3 is a section view taken along the line 3—3 of FIG. 2.
Figure 7:
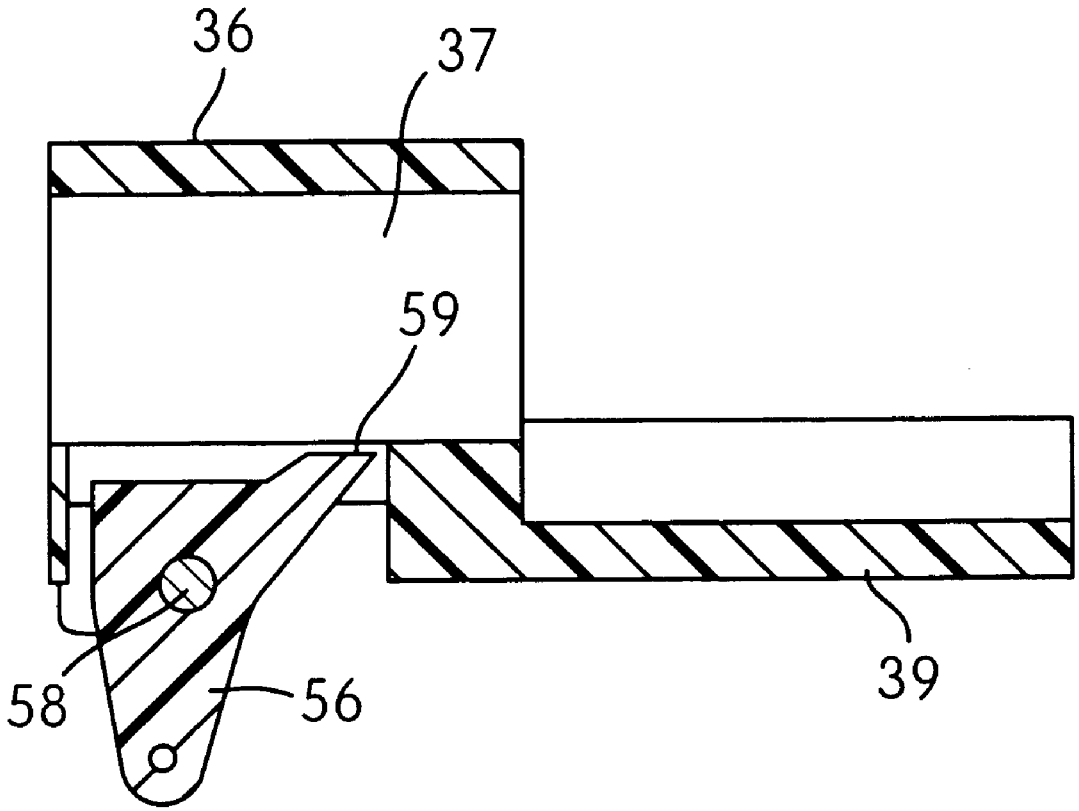
FIG. 7 is an cross-sectional view of the pusher utilized in the glue gun of FIG. 1.

FIG. 3 is a section view taken along the line 3—3 of FIG. 2. The trigger 16 is rotatably attached to the housing 12 by pivot pin 50 and is biased towards the non-actuated position by a biasing spring 52. An actuating arm 54 is connected between the trigger 16 and an engaging member 56 of the adhesive pusher 36. As can be best seen in FIG. 7, the engaging member 56 is pivotally connected to the pusher 36 by a pin 58 and has an engaging portion 59 which faces into the bore 37. The actuating arm 54, trigger 16 and engaging member 56 are constructed and arranged such that, as the operator moves the trigger 16 to its actuated position, the adhesive pusher 36 is drawn forward towards the heating element 80 by actuating arm 54. As the adhesive pusher 36 moves forward, the actuating arm 54 pivots the engaging member 56 in an engaging direction such that the engaging portion 59 thereof moves into engagement with the solidified adhesive 42 within the bore 37. The forward movement of stick 42 causes any molten adhesive at the lead end portion to be forced outwardly from the nozzle 18. The engaging portion has a ribbed surface engageable with the glue stick 42 to assist in gripping the stick and urging it forwardly.

As the trigger 16 is actuated, a switching boss (not shown) projecting from the trigger 16 engages a switch arm 60, which actuates switch 58 to enable an electric signal to flow through the heating element 80 to generate heat sufficient to melt the lead end portion of stick 42. As the trigger 16 is released by the user, the switch 58 is turned off, and a controller 70 controls an amount of time that the electric signal flows through the heating element 80. Preferably, the heating element is of the PTC type and controlling the amount of time the signal flows will extend the useful life of the element 80. However, the element 80 is not limited to being the PTC type. The controller 70 will be described in more detail hereinafter.

A heating indicator 52 consisting of a neon bulb 62 or the like lights up when an electric is applied to the heating element 80 so that an operator can usually verify that the heating element 80 is activated. As the time determined by the controller 70 expires and the electric signal ceases to be supplied to the heating element 80, the heating indicator 52 turns off.

Figure 4:
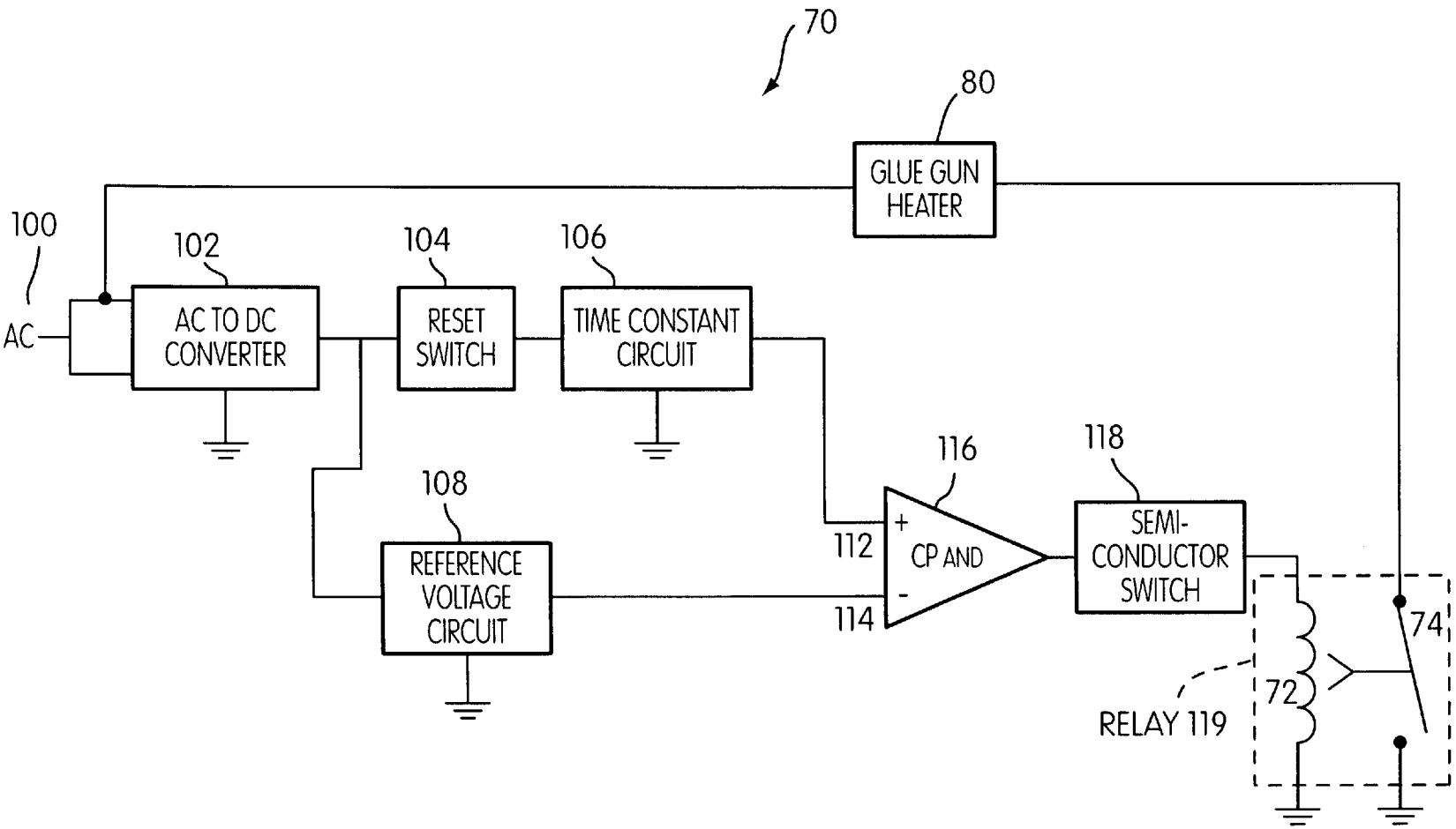
FIG. 4 is a function block diagram of the auto shut-off circuit of a preferred embodiment of the present invention.

FIG. 4 provides a block diagram of a controller 70 constructed in accordance with the principles of the present invention. The controller 70 is powered by an AC signal source 100, which provides an AC signal to an AC to DC converter 102. A standard wall outlet typically provides the AC signal via the power cord 40. The principles of the present invention, however, are not limited to using an AC signal source for the power and may be practiced with a DC signal source.

The output of the AC to DC converter 102 is connected to a reset switch 104 and also to a reference voltage circuit 108. The output of the reset switch 104 is connected to a time constant circuit 106. The output $V_{timing}$ of the time constant circuit 106 is connected to the non-inverting terminal 112 of an operational amplifier 116, while the output of the reference voltage circuit 108 is connected to the inverting terminal 114 of the operational amplifier 116. The operational amplifier 116 is connected in an open-loop configuration.

The output of the operational amplifier 116 leads to a semiconductor switch 118, the output of which leads to a coil 72 of a relay 119. The output of the AC signal source 100 also leads to the heating element 80, which is connected between the AC signal source 100 and a switch 74 of the relay 119. The controller 70 will now be described in more detail.

Figure 5:
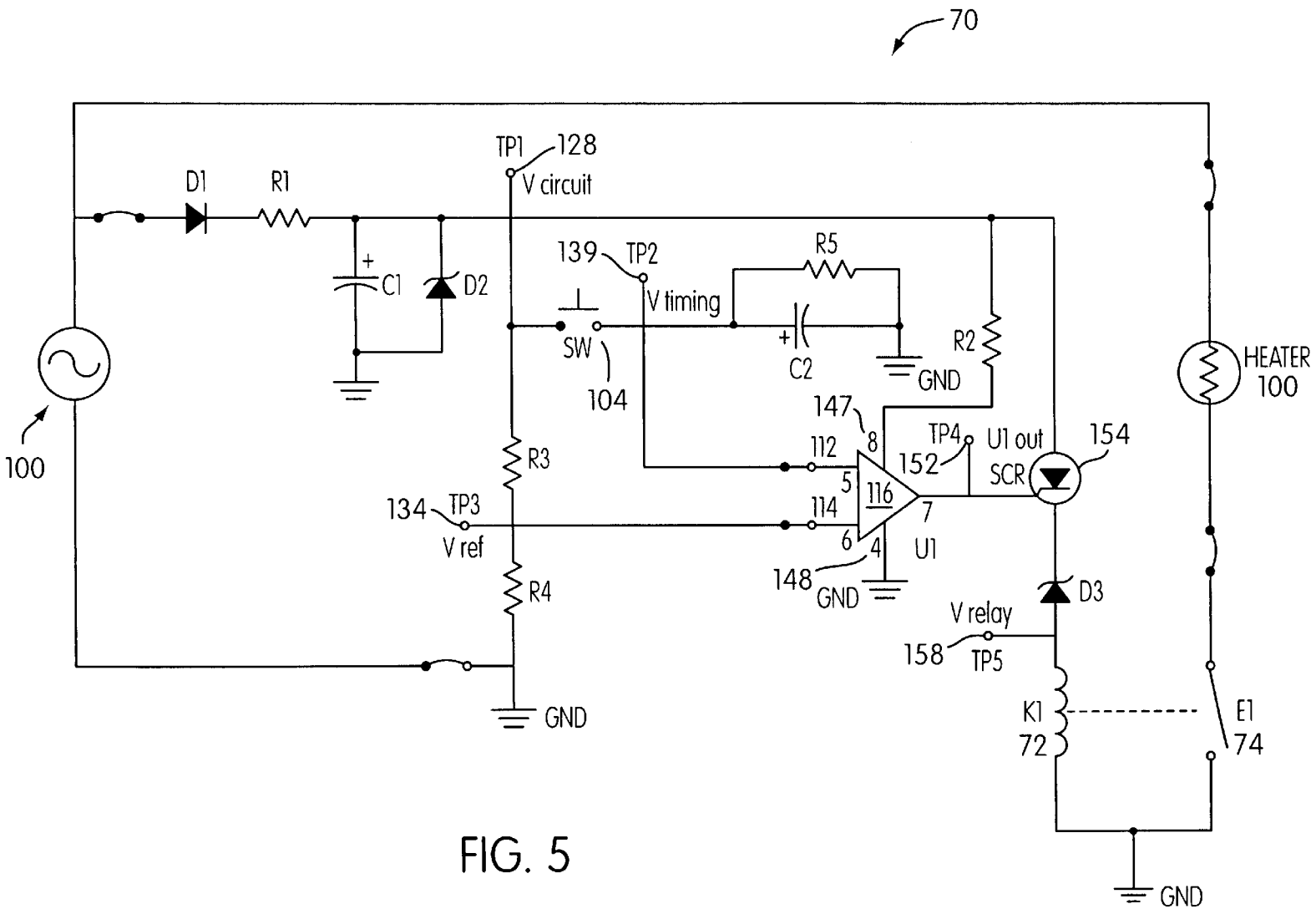
FIG. 5 is a schematic diagram of the auto shut-off circuit of the preferred embodiment of the present invention.

As shown in FIG. 5, the AC to DC converter 102 comprises a first diode (D1) having its cathode connected in series to a first resistor (R1). Between the output of R1 and ground is connected a first capacitor (C1) in parallel with a second diode (D2). A node voltage at the output of R1 is defined at node 128 as $V_{circuit}$. D2 is preferably a zener-type diode with the cathode connected to R1 and its anode connected to ground. A second resistor (R2) is connected between R1 and a first power supply terminal 147 of the operational amplifier 116. The second power supply terminal 148 of the operational amplifier 116 is connected to ground. The AC current source is connected to the anode of D1.

A reference voltage circuit 108 comprises a third resistor (R3) and a fourth resistor (R4) connected in series between the node 128 and ground to define a voltage divider. A reference voltage $V_{ref}$ at node 134 is defined between R3 and R4. $V_{ref}$ is input to the inverting terminal 114 of the operation amplifier 116. Between the reset switch 104 and the time constant circuit 106 is defined a node 139 having a voltage $V_{timing}$ thereat. The time constant circuit 106 comprises a fifth resistor (R5) and a second capacitor (C2) connected in parallel between the reset switch 104 and ground. $V_{timing}$ (the output of the time constant circuit 106) is input to the non-inverting terminal 112 of the operational amplifier 116.

The voltage at the output of the operational amplifier 116 is defined as $V_{out}$ and can be measured at node 152. $V_{out}$ is input to the semiconductor switch 118, which comprises a silicone control rectifier (SCR) 154 and a third diode (D3). D3 is preferably a zener diode having its cathode connected to the SCR 154. The SCR 154 is controlled by the voltage $V_{out}$ from the operational amplifier. When $V_{out}$ is high, the SCR 154 supplies $V_{circuit}$ to the cathode of D3. With the voltage higher at the cathode of the D3, current flows through D3 and $V_{circuit}$ is supplied to the relay 119. The relay 119 comprises a relay coil (K1) 72 and a relay contact (E1) 74. When the relay coil 72 is energized by $V_{circuit}$, the relay contact 74 is closed and current flows from the AC signal source to the heating element 80 through the relay contact 74 to ground.

B. Operation

The operation of the glue gun 10 having a controller 70 will be described with general reference to FIGS. 4–6.

The normally open time constant circuit 106 is responsive to the closure of the reset switch (SW) 104 connected to and actuated by the manually operable glue gun trigger 16. The switch closure charges C2, also referred to as the timing capacitor, through R5 creating a voltage differential at the inputs 112, 114 of the operational amplifier 116. The output of the voltage, $V_{out}$, is proportional to the difference between the voltages at the non-inverting terminal 112 and inverting terminal 116. The voltage differential at the input terminals 112, 114 of the operation amplifier 116 generates a high output signal $V_{out}$ from the operational amplifier 116.

The output of the time constant circuit 106, $V_{timing}$, is applied to the non-inverting input 112 and the output of the reference voltage circuit, $V_{ref}$, is applied to the inverting input 114 of the operational amplifier 116. $V_{out}$ is input to the semiconductor switch 118 that controls the electro-mechanical relay 119. The AC line voltage provides an AC signal to the heating element 80 of the glue gun 10 when the electrical relay contact 74 of the electro-mechanical relay 119 is closed. Upon opening the reset switch 104, the electrical relay switch 74 remains closed for a time period determined by the natural response or exponential decay from the initial voltage of the time constant circuit 106. C2 and R5 govern the rate of decay according to the following formula:

$$V_{timing}=V(0)e^{(-t/RC)} \quad (1)$$

wherein V(0) is the value of $V_{timing}$ when the reset switch 104 is opened or actuated, i.e., when t=0, t is the time, R is the value of R5 in ohms and C is the value of C2 in farads.

Figure 6:
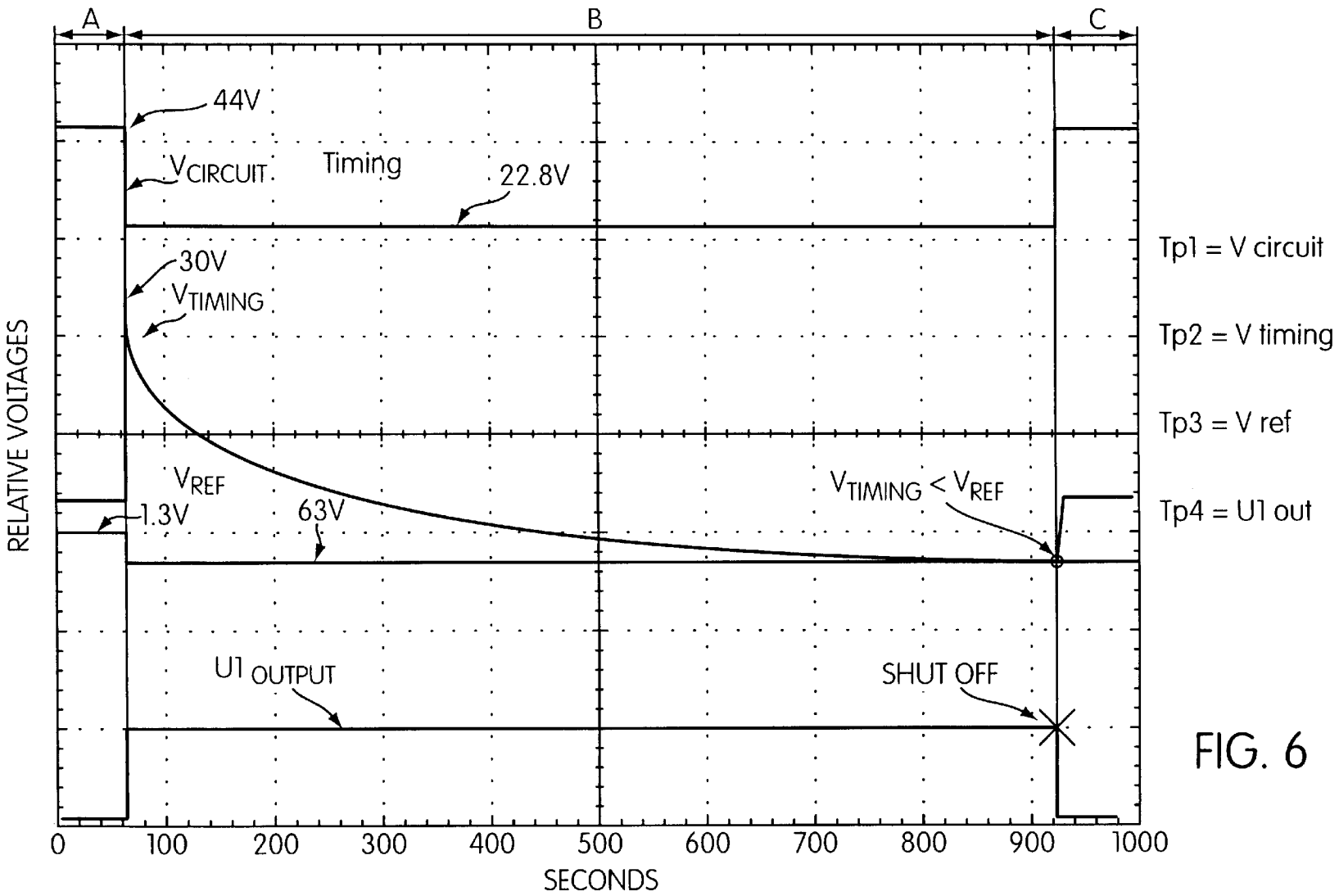
FIG. 6 is an illustration of the dynamic waveforms encountered in the operation of the preferred embodiment of the present invention.

FIG. 6 provides an illustration of the dynamic waveforms encountered in the operation of the preferred embodiment of the present invention. Voltage readings are taken at four circuit nodes (TP1, TP2, TP3, TP4) as marked in FIG. 5; the corresponding voltage readings are denoted as $V_{circuit}$, $V_{timing}$, $V_{ref}$, and $V_{out}$. Voltage $V_{circuit}$ represents an internal voltage value at node TP1, voltage $V_{timing}$ represents the voltage at node TP2 which is associated with the timing signal generated by time constant circuit 106, voltage $V_{ref}$ represents the voltage of the reference signal created by the reference voltage circuit 108, and $V_{out}$ represents the voltage of the control signal output by the operational amplifier 116. Three time periods A, B and C along the horizontal axis of FIG. 6 correspond to three operational stages of the glue gun.

The relative voltages measured on the vertical axis are plotted on different scales (e.g., TP1: 20V/cm, TP2: 10V/cm and TP4: 25V/cm). FIG. 6 illustrates qualitatively the time variation in the voltage levels during operation of the circuit.

Time period A represents the circuit operation after plugging in the glue gun 10 but prior to actuating the trigger 16 and closing the reset switch 104. When the circuit is plugged into a wall outlet to supply a 120 volt AC signal to the controller 70, the first diode 120 conducts current on the positive half cycle and current flows through R1 charging C1 and the zener diode D2 limits the voltage. The resulting voltage at $V_{circuit}$ is approximately 44 volts. The voltage drop across R2 reduces the voltage to the desired level to power the operational amplifier 116.

R3 and R4 form a voltage divider which divides $V_{circuit}$ to provide the reference circuit signal with a $V_{ref}$ of approximately 1.3 volts. $V_{ref}$ is applied to apply to the inverting terminal 114 of the central signal output by operational amplifier 116. Prior to actuating the trigger 16, C2 is discharged and the non-inverting input 112 of the operational amplifier 116 is held at ground via R5. The voltage $V_{out}$ of the operational amplifier 116 therefore drops to a low value. A low $V_{out}$ at the gate of the silicon gate rectifier (SCR) 154 prevents current from flowing from $V_{circuit}$ to the relay 119, thus coil 72 is de-energized, switch 74 is open and current cannot flow from the AC signal source through the heating element 80.

When the user moves the trigger 16 to its actuated position, the reset switch 104 closes. C2 charges up to approximately 30 volts, thus the voltage $V_{timing}$ of the timing signal is approximately 30 volts. Charging C2 provides a voltage differential to cause the output of the operational amplifier 116 to go high, thereby activating the silicon control rectifier 154. The silicon control rectifier 154 supplies $V_{circuit}$ to D3, thereby energizing the relay coil 72. Energizing the relay coil 72 drops $V_{circuit}$ to approximately 23 V and lowers $V_{ref}$ to approximately 0.63 V. The relay contact 74 is closed and AC line voltage flows through the heater element 110 and generates heat to melt the lead end portion of the solidified adhesive supply.

The semiconductor switch 118 and relay 119 may be broadly considered together to define a switching element which moves between a flow permitting position wherein the AC signal can flow to the heating element 80 and a flow preventing position wherein the AC signal is prevented from flowing to the heating element 80. Other switching arrangements, such as transistor-based switched may be utilized in place of the disclosed switching element. Thus, the term switching element should not be considered to be limited to the disclosed relay/rectifier arrangement.

Time period B represents the operation of the controller 70 after the user releases the trigger 16 and thus opens the reset switch 104. The timing cycle begins as the timing capacitor 140 exponentially discharges its energy or voltage through the fifth resistor 138 according to the timing constant R5*C2. When $V_{timing}$ drops below the reference voltage $V_{ref}$ by an amount determined by the operational amplifier's 116 output saturation voltage divided by its open loop gain, then $V_{out}$ drops to a low value thereby switching the silicon control rectifier 154 off. The relay 119 drops out (i.e., the relay contact 74 opens), thereby stopping the flow of AC current through the heater element 80. When $V_{timing}$ equals $V_{ref}$ then the differential voltage across the input terminals of the operational amplifier 116 will be approximately zero and the output of the operational amplifier 116 ($V_{out}$) will go low or be approximately zero. The estimated time required to switch to the off or flow preventing condition is given by:

$$t_{off}=-1n(V_{(t)}/V_0)\cdot R5\cdot C2 \text{ seconds} \quad (2)$$

The time $t_{off}$ in equation (2) is derived from solving equation (1) for "t" wherein $V_{(t)}$ is the voltage at the timing capacitor or $V_{timing}$, and $V_0$ is the initial value of $V_{timing}$ when the reset switch is opened (i.e. non-actuated), or the trigger is released. Substituting nominal values for the preferred embodiment provides:

$$t_{off}=-1n(0.63/30)\cdot 10(M\text{-ohms})\cdot 22(\mu\text{-farads})=850 \text{ seconds} \quad (3)$$

In equation (3), "1n" means the natural logarithmic function, 0.63 is the preferred value of $V_{ref}$ in volts, 30 is the preferred value of $V_0$, 10 mega-ohms is the preferred value of R5 and 22 micro-farads is the preferred value of C2. For the test case illustrated in FIG. 6, the time measured was 886 seconds. Time period C represents circuit operation as the $V_{timing}$ drops below $V_{ref}$, and the circuit switch stops flow of current to the heating element 80. As $V_{timing}$ drops below $V_{ref}$, $V_{out}$ drops to approximately zero, thereby switching the silicon control rectifier 154 off. The relay contact 74 opens preventing the AC current from flowing to the heating element 80. The relay off condition causes voltage $V_{circuit}$ and voltage $V_{ref}$ to increase. C2 will be re-charged (to approximately 30 V) with every closure of the reset switch 104, thereby resetting the timer.

It will thus be seen that the objectives of the present invention have been fully and effectively accomplished. It will be realized, however, that the foregoing preferred specific embodiment has been shown and described for the purpose of illustrating the functional and structural principles of the present invention and is subject to change without departure from such principles. Therefore, the present invention includes all modifications, substitutions, and alternations encompassed within the spirit and scope of the following claims.

It should be noted that claim language in the 'mean for performing a specified function' format permitted by 35 U.S.C. §112,¶6 has been omitted from the appended claims. This is to make clear that the claims are not intended to be interpreted under §112,¶6 as being limited solely to the structures disclosed in the present application and their equivalents.

I claim:

1. A glue gun for selectively applying molten adhesive, said gun comprising:

a housing having a manually engageable handle portion;

a manually operable actuator movable between an actuated position and a non-actuated position;

a nozzle configured to allow molten adhesive to flow therethrough;

an interior surface defining an adhesive receiving chamber fluidly communicated with said nozzle, said chamber having an opening at one end thereof for allowing a supply of solidified adhesive to be inserted into said chamber;

a heating element associated with said chamber, said heating element being positioned so as to be disposed adjacent to a lead end portion of the solidified adhesive supply when the adhesive supply is inserted into said chamber;

said heating element being operable to apply heat to the lead end portion of the solidified adhesive supply sufficient to melt the lead end portion when an electric signal is supplied to said heating element;

said chamber being constructed and arranged such that pressure can be applied to the solidified adhesive supply so as to force the molten adhesive from the lead end portion thereof outwardly through said nozzle; and a heating element controller having a signal source input adapted to be connected to an electric signal source in power supplying relation;

said controller being operable to connect said heating element to the signal source input so as to allow an electric signal from the signal source to flow through the heating element in response to said actuator being moved to said actuated position thereof, thereby causing the heating element to generate and apply heat to the lead end portion of the solidified adhesive supply;

said controller being operable to allow the electric signal to flow from the signal source through said heating element for a predetermined time period after said actuator has been moved to said non-actuated position and to thereafter prevent the electric signal from flowing through said heating element at the end of the predetermined time period, thereby causing said heating element to continue applying heat to the lead end portion of the solidified adhesive supply for the predetermined time period and then subsequently allowing said heating element to cool.

2. A glue gun according to claim 1, wherein the input of said controller is adapted to be connected to an AC signal source and wherein said controller comprises:

an AC to DC converter operable to receive an AC signal from the AC signal source and to convert the received AC signal to a DC signal;

a time constant circuit operable to produce a timing signal having a voltage $V_{timing}$;

a reset switch operatively associated with said actuator and positioned between said converter and time constant circuit, said reset switch being operable to allow the DC signal to flow from said converter to said time constant circuit when said actuator is in the actuated position thereof and to prevent the DC signal from flowing from said converter to said time constant circuit when said actuator is in the non-actuated position thereof;

a reference voltage circuit connected to said input, said reference voltage circuit being operable to produce a reference signal having a voltage $V_{ref}$;

an operational amplifier having a non-inverting terminal receiving the timing signal from the time constant circuit and an inverting terminal receiving the reference signal from the reference voltage circuit, said operational amplifier being operable to produce a control signal proportional to the difference between $V_{timing}$ and $V_{ref}$;

a switching element connected to said operational amplifier and receiving the control signal therefrom, said switching element being movable between (1) a flow permitting position wherein said switching element allows the AC signal to flow from the AC signal source to the heating element and (2) a flow preventing position wherein said switching element prevents the AC signal from flowing from the AC signal source to the heating element;

said switching element being operable to move to the flow permitting position thereof when the control signal is high as a result of $V_{timing}$ being greater than $V_{ref}$ and to move to the flow preventing position thereof when the control signal is low as a result of $V_{timing}$ being equal to $V_{ref}$;

said time constant circuit being operable to become energized when said actuator is moved to said actuated position thereof such that, after said actuator is moved to said non-actuated position thereof (a) said time constant circuit will continue to supply a timing signal to the non-inverting terminal of said operational amplifier and (b) the voltage $V_{timing}$ of the timing signal will thereafter decay over a period of time until $V_{timing}$ equals $V_{ref}$, thereby causing said switching element to move to the flow preventing position thereof as a result of the control signal from the operational amplifier being low and preventing the AC signal from flowing to the heating element.

3. A glue gun according to claim 2, wherein said time constant circuit comprises a capacitor and a resistor connected in parallel between ground and the non-inverting terminal of said operational amplifier.

4. A glue gun according to claim 2, wherein said AC to DC converter comprises a first diode and a resistor connected in series and a capacitor and a second diode connected in parallel between ground and said resistor.

5. A glue gun according to claim 2, wherein said reference circuit comprises first and second resistors connected in series between said AC to DC converter and ground to define a voltage divider, the inverting terminal of said operational amplifier being connected between said first and second resistors.

6. A glue gun according to claim 2, wherein said switching element comprises:

a silicon rectifier connected to said AC to DC converter and said operational amplifier, said rectifier being movable between (1) an open position wherein the DC signal from said converter is allowed to flow through said rectifier when said control signal is high as a result of $V_{timing}$ being greater than $V_{ref}$ and (2) a closed position wherein the DC signal from said converter is prevented from flowing through said rectifier when said control signal is low as a result of $V_{timing}$ being equal to $V_{ref}$;

a relay with a relay coil and a relay switch, said relay coil being connected between said silicon rectifier and ground;

said relay coil being operable to move said relay switch to a closed position as a result of said DC signal flowing through said coil when said rectifier is in the closed position thereof and to allow said relay switch to move to an open position as a result of the DC signal no longer flowing through said coil when said rectifier is in the open position thereof;

said relay switch being operable to allow the AC signal to flow through said heating element when said relay switch is in said closed position and to prevent the AC signal from flowing through said heating element when said relay switch is in said open position.

7. A glue gun according to claim 6, wherein said switching element further comprises a diode connected in series with said coil and said rectifier, the cathode of said diode being connected to said rectifier and the anode of said diode being connected to said coil.

8. A glue gun according to claim 7, wherein said diode is a zener diode.

9. A glue gun according to claim 1, further comprising an adhesive pusher constructed and arranged to push the solidified adhesive supply forwardly towards said nozzle such that the molten adhesive from the lead end portion is forced outwardly through said nozzle.

10. A glue gun according to claim 9, wherein said adhesive pusher is slidably mounted within said housing.

11. A glue gun according to claim 10, further comprising an actuating arm, said actuator being a trigger pivotally mounted to said housing, said actuating arm being connected between said trigger and said pusher such that moving said trigger beyond said actuating position thereof moves said pusher forwardly to push the solidified adhesive supply towards said nozzle.

12. A glue gun according to claim 11, wherein said pusher has a generally cylindrical bore formed therethrough, the solidified adhesive supply being received within said bore.

13. A glue gun according to claim 12, wherein said pusher has a pivotally mounted engaging member with an engaging portion extending inwardly into said bore, said actuator arm being connected to said engaging member such that moving said trigger beyond the actuated position thereof moves the engaging portion of said engaging member into tight engagement with the solidified adhesive supply.

14. A glue gun according to claim 12, wherein said engaging portion of said engaging member has a ribbed surface engageable with the solidified adhesive supply.

* * * * *